United States Patent [19]

Saitoh

[11] Patent Number: 4,946,396

[45] Date of Patent: Aug. 7, 1990

[54] ADAPTER FOR CONNECTOR TO EXTERNAL POWER SUPPLY

[75] Inventor: Shinya Saitoh, Tokyo, Japan

[73] Assignee: Takara Co., Ltd., Tokyo, Japan

[21] Appl. No.: 423,039

[22] Filed: Oct. 18, 1989

[30] Foreign Application Priority Data

Oct. 19, 1988 [JP] Japan ..... 63-263586

[51] Int. Cl.[5] ..... H01R 3/00; H01R 11/00

[52] U.S. Cl. ..... 439/500; 439/502; 439/628; 439/638

[58] Field of Search ..... 439/500–502, 439/504, 628, 638, 640, 641, 654, 655, 687, 688, 700

[56] References Cited

U.S. PATENT DOCUMENTS 3,998,516 12/1976 Mabuchi ..... 439/628
4,037,026 7/1977 Mabuchi ..... 439/500
4,131,805 12/1978 Austin et al. ..... 439/638
4,214,804 7/1980 Little ..... 439/502
4,221,454 9/1980 Wong ..... 439/500

*Primary Examiner*—Paula A. Bradley
*Attorney, Agent, or Firm*—Price, Gess & Ubell

[57] ABSTRACT

An adapter for connection to an external power supply capable of readily actuating a battery-operated device through the external power supply by merely fitting an adapter body in a battery box of the device and electrically connecting a connector of the adapter to the external power supply. The adapter an adapter body detachably fitted in a battery box of the battery-operated device, a connector electrically connected to the external power supply, and contacts electrically connected to contacts of the battery box. The contacts of the adapter is arranged at the adapter body.

11 Claims, 4 Drawing Sheets

ADAPTER FOR CONNECTOR TO EXTERNAL POWER SUPPLY

BACKGROUND OF THE INVENTION

This invention relates to an adapter for connection to an external power supply, and more particularly to an adapter detachably connected between an external power supply such as a domestic power supply and a battery box of a battery-operated device such as a battery-operated toy to supply the device with an external electric power.

Conventionally, a battery-operated device such as a battery-operated toy using a battery means as its power supply includes a battery box provided with an electrical contact section, into which a vessel having a plurality of batteries received therein is inserted.

The conventional battery-operated toy is constructed so as to utilize only the battery means, so that it is not possible to connect it to an external power supply such as a domestic power supply without any alteration. Therefore, when it is desired to connect the battery-operated toy to the external power supply for the purpose of, for example, demonstrating it at a store front or a shopwindow for a long period of time, it is necessarily required to alter a power supply section of the toy such as a battery box so that it may be connected to the domestic power supply. However, such an approach causes the power supply section of the toy to be highly complicated in construction.

Accordingly, it would be highly desirable to develop an adapter for readily connecting a battery-operated device to an external power supply such as a domestic power supply as desired without altering or modifying the construction of the device.

SUMMARY OF THE INVENTION

Generally speaking, in accordance with the present invention, an adapter for connection to an external power supply is provided. The adapter comprises an adapter body detachably fitted in a battery box of a battery-operated device, a connector electrically connected to the external power supply, and contacts electrically connected to contacts of the battery box. The contacts of the adapter is arranged at the adapter body.

In accordance with the present invention, there is also provided an adapter for connection to an external power supply which comprises at least two contact holders detachably fitted in a battery box of a battery-operated device and connected to each other in a manner to be foldable together so that they may be selectively arranged in series or in parallel to each other, contacts arranged at the contact holders so as to be electrically connected to contacts of the battery box, an electrical cord led out at one end thereof from the contact holders, and a connector provided at the other end of the electrical cord so as to be electrically connected to the external power supply.

Also, in accordance with the present invention, an adapter for connection to an external, power supply. The adapter comprises an adapter body formed into a box-like shape so as to be detachably fitted in a battery box of a battery-operated device, contacts arranged at the adapter body so as to be electrically connected to contacts of the battery box, and a connector arranged at the adapter body so as to be electrically connected to the external power supply.

Further, in accordance with the present invention, an adapter for connection to an external power supply. The adapter includes an adapter body detachably fitted in a battery box of a battery-operated device. The adapter body includes two halves threadedly fittedly connected to each other in a manner to be movable with respect to each other in the longitudinal direction thereof so that the length of the adapter body may be varied by threadedly moving the halves in relation to each other. The adapter also includes contacts arranged at the adapter body so as to be electrically connected to contacts of the battery box and a connector arranged at the adapter body so as to be electrically connected to the external power supply.

Accordingly, it is an object of the present invention to provide an adapter for connection to an external power supply which is capable of permitting a battery-operated device to be readily actuated through an external power supply without altering the construction of the battery-operated device.

It is another object of the present invention to provide an adapter for connection to an external power supply which is capable of readily connecting a battery-operated device to an external power supply by merely fitting the adapter in a battery box of the device and connecting it to an external power supply.

It is a further object of the present invention to provide an adapter for connection to an external power supply which is capable of varying its size depending on a battery box of a battery-operated device, to which the adapter is to be applied.

It is still another object of the present invention to provide an adapter for connection to an external power supply which is capable of accomplishing the above-noted objects with a simple structure.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein.

DETAILED DESCRIPTION OF THE PREFERRED EMBODIMENTS

Now, an adapter for connection to an external power supply according to the present invention will be described hereinafter with reference to the accompanying drawings.

The following description will be made in connection with the connection of a battery-operated toy to a domestic power supply through an adapter of the present invention. However, the present invention is not limited to such applications.

Figure 1:
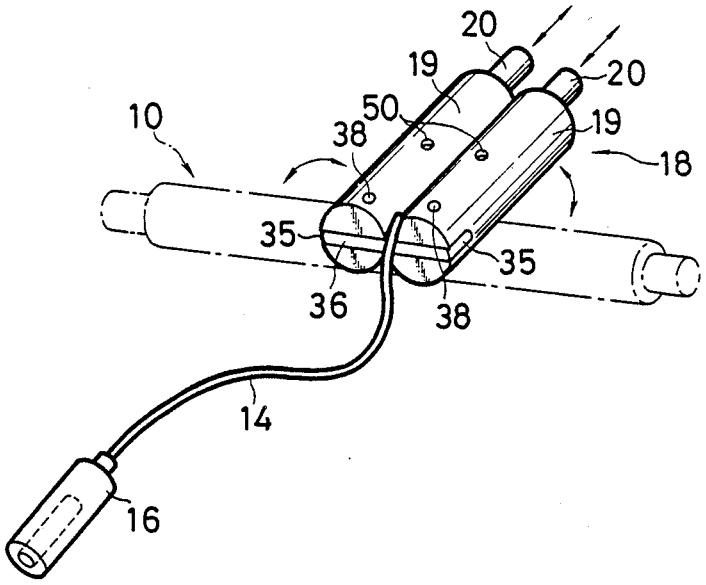
FIG. 1 is a perspective view showing an embodiment of an adapter for connection to an external power supply according to the present invention.
Figure 2:
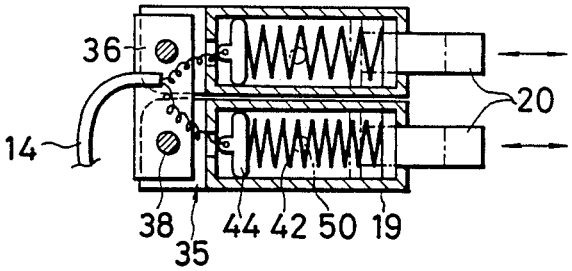
FIG. 2 is a fragmentary cross sectional view showing an essential part of the adapter shown in FIG. 1.
Figure 3:
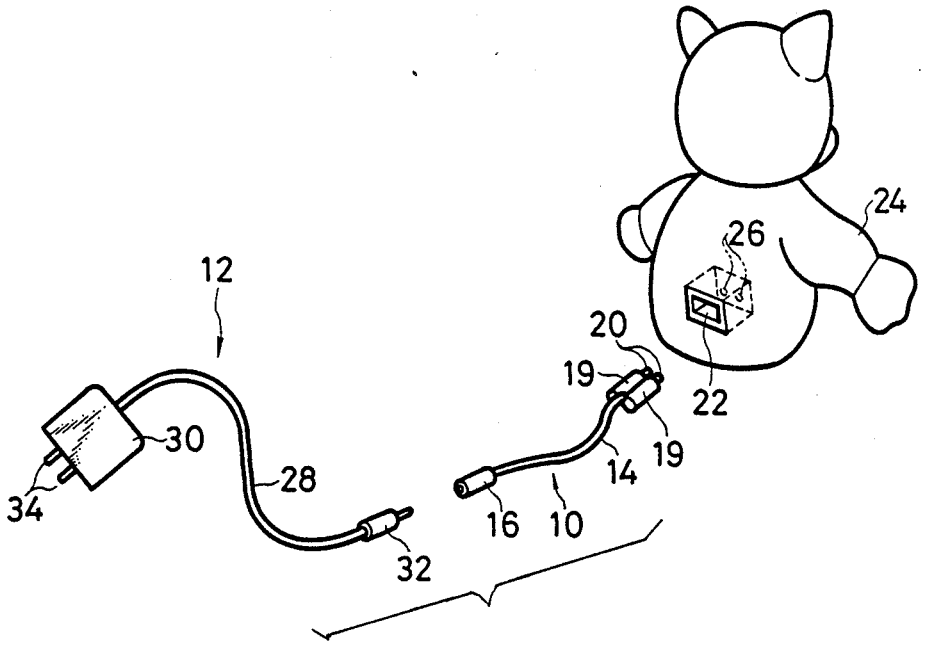
FIG. 3 is an exploded perspective view showing the manner of use of the adapter shown in FIG. 1.

FIGS. 1 to 3 show an embodiment of an adapter for connection to an external power supply according to the present invention, which is adapted to connect a battery-operated toy to a domestic power supply according to the present invention, wherein an adapter of the illustrated embodiment is generally designated by reference numeral 10. The adapter 10 is adapted to be detachably connected to an AC adapter 12 for converting a voltage of an electric power from a domestic power supply to a predetermined voltage and rectifying an AC current to a DC current. For this purpose, the adapter 10 of the illustrated embodiment includes an electrical cord 14 provided at one end thereof with a connector 16 adapted to be detachably connected to the AC adapter 12 as described hereinafter. Also, the adapter 10 of the embodiment includes an adapter body 18 arranged at the other end of the cord 14. In the illustrated embodiment, the adapter body 18 comprises at least two contact holders 19. The contact holders 19 each supportedly hold a contact 20 electrically connected to the other end of the cord 14. The contact holders 19 are connected to each other in a manner to be foldable together and constructed in a manner to be detachably fitted in a battery box 22 of a battery-operated toy 24, as described in detail hereinafter. In the battery box 22 are provided contacts 26 to which the contacts 20 of the adapter 10 are electrically connected.

When the toy 24 is actuated by batteries, they are received in the battery box 22.

The AC adapter 12 includes an electrical connection cord 28, a box-like converter 30 mounted on one end of the cord 28 and a connection means or connector 32 mounted on the other end of the cord 28. The converter 30 includes an input connection means 34 adapted to be inserted into a socket (not shown) for a domestic power supply, a voltage converting circuit (not shown) arranged therein for carrying out the voltage conversion of an electric power supplied through the socket from the domestic power supply and a rectifying circuit (not shown) arranged therein for rectifying the electric power. The connector 32 is adapted to be connectable to the connector 16 of the adapter 10.

In the adapter 10 of the illustrated embodiment briefly described above, the contact holders 19 each are formed into a cylindrical shape like a battery and provided at the rear or proximal end thereof with a horizontal groove 35. The horizontal grooves 35 of both contact holders 19 are arranged in a manner to be aligned with each other, in which a connecting member 36 is loosely fitted. More particularly, the connecting member 36 is fitted at each end thereof in each of the grooves 35 and connected to the contact holder 19 through a support pin 38 so as to horizontally pivotally move the contact holder 19 about the support pin 38 with respect to the connecting member 36. This results in the contact holders 19 being foldable with respect to each other so as to be arranged in parallel with each other as indicated at solid lines in FIG. 1, as well as being extendable with respect to each other so as to be arranged in series as indicated at phantom lines.

The contact 20 is provided at the front or distal end of each of the contact holders 19 and arranged in a manner to be retractable with respect to the contact holder 19. More particularly, in each of the contact holders 19 is arranged an elastic element 42 of which one end is engaged with the proximal end of the contact 20 for constantly force the contact 20 in the outward direction. The elastic element 42 is made of a conductive material and, in the illustrated embodiment, comprises a compressed spring. Also, in each of the contact holder 19 is arranged a stopper member 44 which is engaged with the other end of the spring 42 to hold the spring 42. Such construction causes each of the contacts 20 to be constantly elastically biased to outwardly project from the contact holder 19. The electrical cord 14 is mechanically and electrically connected at the distal end thereof to each of the stopper members 44. Thus, it will be noted that the connector 16, cord 14, stopper members 44, springs 42 and contacts 20 are electrically connected to one another in order.

Figure 4:
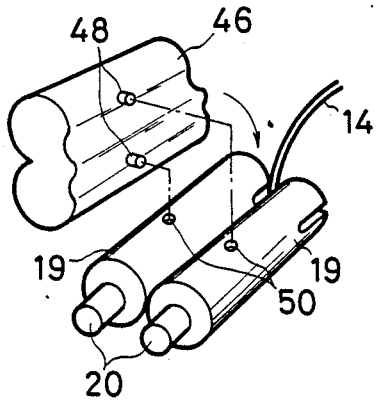
FIG. 4 is an exploded perspective view showing a padding and the manner of mounting of the padding on an adapter body of the adapter shown in FIG. 1.
Figure 5:
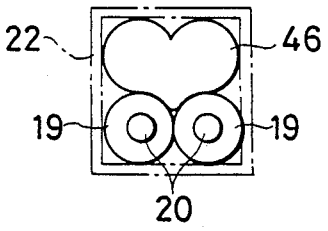
FIG. 5 is an end view showing the mounting of a padding on an adapter body.

The adapter 10 of the illustrated embodiment may include an attachment or padding 46 acting as, for example, a space filler depending on the configuration and/or size of the battery box 22 of the toy 24, as shown in FIGS. 4 and 5. The padding 46 is adapted to be placed on or under the contact holders 19 arranged in parallel with each other to stably position them in the battery box 22. For this purpose, the padding 46 is formed into a shape which causes the padding 46 to be fitted on the contact holders 19 arranged in parallel. In the illustrated embodiment, it may be formed into a heart-like shape as shown in FIG. 5. Also, the padding 46 is formed on the lower surface thereof with a pair of small projections 48 in a manner to positionally correspond to holes 50 formed at the upper and lower surfaces of the contact holders 19 so that it may be fittedly seated or put on the contact holders 19 through the engagement between the projections 48 and the holes 50. Such construction of the illustrated embodiment permits the contact holders 19 to be stably arranged in the battery box even when it, is large-sized as compared with the contact holders 19, as shown in FIG. 5.

In the illustrated embodiment, the padding 46 is formed into a heart-like shape. However, the padding 46 is not limited to such a shape. It may comprise a flexible cushioning material. In this instance, it is not necessarily required to accurately form it into a predetermined shape. Alternatively, batteries or the like may be used as the padding 46.

Figure 6:
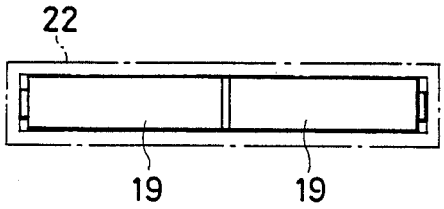
FIG. 6 is a front elevation view showing another manner of fitting contact holders in a battery box.

Also, in the illustrated embodiment, the contact holders 19 are received in the battery box in a manner to be folded with respect to each other as shown in FIG. 5. However, they are arranged in the battery box 22 in a manner to be linearly expanded depending on the configuration of the battery box 22, as shown in FIG. 6.

Now, the manner of operation of the adapter 10 of the illustrated embodiment will be described hereinafter with reference to FIGS. 1 to 6.

First, the contact holders 19 of the adapter 10 are fitted in the battery box 22 of the toy 24 and the connector 16 of the adapter 10 is connected to the connector 32 of the AC adapter 12. Then, the input connection means 34 provided at the converter 30 of the AC adapter 12 is inserted into a socket for a domestic power supply. Thereafter, a switch (not shown) of the toy 24 is turned on. This causes a suitable voltage to be supplied from the power supply to the toy 24, resulting in the toy being operated. In this instance, the padding 46 may be used depending on the configuration and/or size of the battery box 22 as shown in FIGS. 4 and 5. Also, the contact holders 19 may be arranged in the battery box 22 in a manner to be expanded depending on the configuration of the battery box 22, as shown in FIG. 6.

Thus, it will be noted that the adapter of the illustrated embodiment facilitates the supply of a domestic electric power to the toy for operating it by merely fitting the contact holders 19 in the battery box 22 of the toy 24 and connecting the adapter to a domestic power supply. Also, in the adapter of the embodiment, the contact holders 19 constituting the adapter body 18 are constructed so as to be foldable with respect to each other and the padding 46 may be arranged in association with the contact holders 18, therefore, the adapter may be accommodated to various configurations and sizes of a battery box of a battery-operated toy to which it is to be applied.

Figure 7:
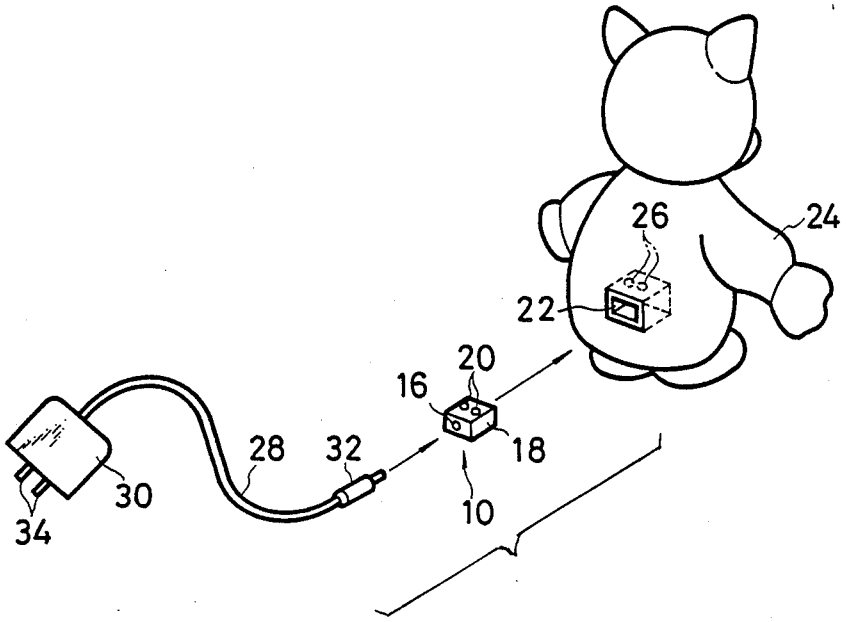
FIG. 7 is an exploded perspective view showing the manner of use of another embodiment of an adapter for connection to an external power supply according to the present invention.

FIG. 7 shows another embodiment of an adapter for connection to an external power supply according to the present invention. An adapter of the embodiment includes an adapter body 18 comprising a single member which is generally formed into a box-like shape so as to be fitted in a battery box 22 of a battery-operated toy 24. On the adapter body 18 are arranged connector 16 connected to a connector 32 of the AC adapter 12 and contacts 20 connected to contacts 26 arranged in the battery box 22. The contacts 40 may be constructed in a manner to be spring-biased as in the embodiment described above. The electrical connection between the connector 16 and contacts 20 may be carried out in such a manner as known in the art.

Figure 8:
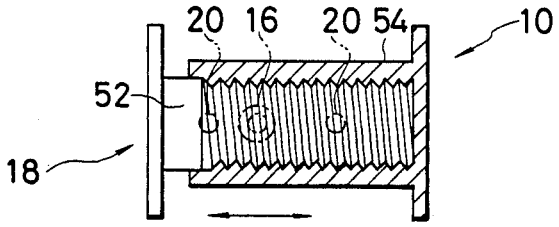
FIG. 8 is a partly sectional view showing a further embodiment of an adapter for connection to an external power supply according to the present invention.

FIG. 8 shows a further embodiment of an adapter according to the present invention. An adapter shown in FIG. 8 is so constructed that its configuration and/or size is variably adjusted depending on the configuration and/or size of a battery box of a battery-operated toy. More particularly, the adapter 10 includes an adapter body 18 comprising two threaded halves 52 and 54 threadedly movably fitted with respect each other so that a length of the adapter body 18 may be varied by threadedly moving the halves 52 and 54 in relation to each other depending on the size of a battery box. On the adapter body 18 are arranged a connector 16 and contacts 20 as indicated phantom lines and dotted lines in FIG. 8, respectively. The electrical connection between the connector 2 and the contacts 20 may be carried out using suitable techniques known in the art.

As can be seen from the foregoing, the adapter of the present invention permits a battery-operated device to be readily actuated through an external power supply by merely fitting the adapter body in a battery box of the device and electrically connecting the connector to the external power supply.

it will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. An adapter for connection to an external power supply, comprising:

an adapter body detachably fitted in a battery box of a battery-operated device;

a connector electrically connected to the external power supply; and contacts electrically connected to contacts of said battery box;

said contacts of said adapter being arranged at said adapter body.

2. An adapter as defined in claim 1, wherein said adapter body is formed into a box-like shape;

said connector being provided at said adapter body.

3. An adapter as defined in claim 1, wherein said adapter body comprising two halves threadedly fittedly connected to each other in a manner to be movable with respect to each other in the longitudinal direction thereof so that the length of said adapter body may be varied by threadedly moving said halves in relation to each other;

said connector being provided at said adapter body.

4. An adapter as defined in claim 1, wherein said adapter body comprises at least two contact holders connected to each other in a manner to be foldable together so that they may be selectively arranged in series to or in parallel with each other.

5. An adapter as defined in claim 4, wherein said contact holders are pivotally connected to each other through a connecting member.

6. An adapter as defined in claim 4, wherein said contacts of said adapter are constantly spring-biased in an outward direction.

7. An adapter as defined in claim 4 further comprising an electrical cord led out at one end thereof from said adapter body;

said connector being provided at the other end of said electrical cord.

8. An adapter as defined in claim 7 further comprising a padding received in said battery box together with said adapter body.

9. An adapter for connection to an external power supply comprising:

at least two contact holders detachably fitted in a battery box of a battery-operated device and connected to each other in a manner to be foldable together so that they may be selectively arranged in series or in parallel to each other;

contacts arranged at said contact holders so as to be electrically connected to contacts of said battery box;

an electrical cord led out at one end thereof from said contact holders; and a connector provided at the other end of said electrical cord so as to be electrically connected to the external power supply.

10. An adapter for connection to an external power supply, comprising:

an adapter body formed into a box-like shape so as to be detachably fitted in a battery box of a battery-operated device;

contacts arranged at said adapter body so as to be electrically connected to contacts of said battery box; and a connector arranged at said adapter body so as to be electrically connected to the external power supply.

11. An adapter for connection to an external power supply, comprising:

an adapter body detachably fitted in a battery box of a battery-operated device;

said adapter body comprising two halves threadedly fittedly connected to each other in a manner to be movable with respect to each other in the longitudinal direction thereof so that the length of said adapter body may be varied by threadedly moving said halves in relation to each other;

contacts arranged at said adapter body so as to be electrically connected to contacts of said battery box; and a connector arranged at said adapter body so as to be electrically connected to the external power supply.

* * * * *